United States Patent [19]

Hawkins

[11] 4,110,742

[45] Aug. 29, 1978

[54] ALARM CIRCUIT

[76] Inventor: J. C. Hawkins, Wise, Va. 24293

[21] Appl. No.: 814,724

[22] Filed: Jul. 11, 1977

[51] Int. Cl.[2] ..... G08B 1/00

[52] U.S. Cl. ..... 340/309.1; 361/29; 340/309.4

[58] Field of Search ..... 340/309.1; 361/29

[56] References Cited

U.S. PATENT DOCUMENTS 4,044,288 8/1977 Godfrey ..... 361/29

*Primary Examiner*—Harold I. Pitts

*Attorney, Agent, or Firm*—Kemon & Estabrook

[57] ABSTRACT

An alarm circuit is interlocked with the start circuit of power driven industrial machinery such as a coal tipple so that before the machinery can be started, an alarm must be energized for a predetermined time to alert personnel that the machine is about to start. In the event that the machinery is not started within a predetermined time after termination of the alarm, the whole cycle must be repeated.

3 Claims, 2 Drawing Figures

ALARM CIRCUIT

BACKGROUND OF THE INVENTION

There are numerous instances where industrial machinery would be hazardous to personnel if started when personnel were located too close to such machinery. Particularly in the coal mining industry, there are elongated conveyor belts, the starting controls for which may be so located that the operator can not see the entire belt from the control position. This is merely one example of power driven machinery which need some sort of automatic warning system to alert workmen to the fact that such machinery is about to be started. With the current emphasis on industrial safety and adequate and interlocked alarm system for use in conjunction with power driven industrial machinery is a necessity both practically and to comply with Federal laws.

BRIEF SUMMARY OF THE INVENTION

The present invention provides a positive and fail safe alarm circuit which can be used in conjunction with one or more pieces of power driven industrial equipment. The arrangement is such that before the equipment can be put into operation, a visual and/or audible alarm must be sounded for a predetermined period of time. First and second timing circuits terminate the alarm after a first time period and enable the start circuit of the machinery and a second timing arrangement requires recycling of the first in the event that the machinery is not started within the second predetermined time period, following termination of the alarm.

DETAILED DESCRIPTION OF THE DRAWINGS

Figure 1:
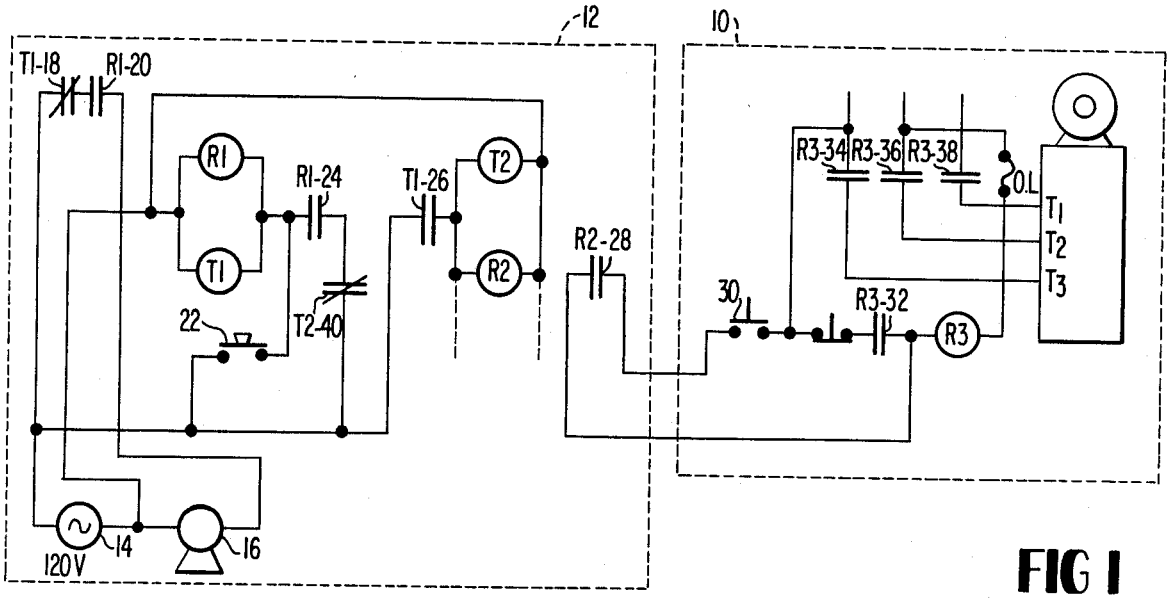
FIG. 1 is a schematic wiring diagram of a first embodiment of the present invention.

Referring first to FIG. 1, any conventional starting arrangement for example for a three phase motor is indicated generally by reference numeral 10. An alarm and timing circuit to be interlocked with the start circuit 10 is indicated generally at 12. The alarm circuit 12 may conveniently be energized from a single phase 120 volt source indicated at 14. The alarm schematically indicated as a horn 16 is connected to the supply through two sets of contacts one normally open an the other normally closed. The normally closed contacts T1-18 are controlled by a time delay T1 and the normally open contacts R1-20 are controlled by relay R1. A manual switch 22 when momentarily closed energizes both R1 and T1 and locks them in the energized state though a set of holding contacts R1-24 controlled by R1. This also closes contacts R1-20 and energizes the warning horn 16. The time delay relay T1 after a predetermined period of time, will open its contacts T1-18 to terminate the alarm even though relay R1 remains energized through its holding contacts R1-24. A further set of contacts T1-26 are normally open and are closed by relay T1 at the same time that the contacts T1-18 are opened. Closing of contacts T1-26 is effective to energize a second pair of relays T2 and R2. Relay R2 controls the interlock between the two circuits through normally open contacts R2-28. As soon as the alarm is terminated therefore, contacts R2-28 are closed and the operator may then start the machinery by momentarily depressing the start button 30 to energize a further relay R3 which locks in through its own contacts R3-32 and supplies energy to the machinery from the three phase supply through the contacts R3-34, 36 and 38. At the same time, however, time delay relay T2 is running and after a predetermined period of time opens its normally closed contacts T2-40 which drops out relays R1 and T1 and returns the entire alarm circuit 12 to its original condition. Unless the machinery has started, therefore, within the time period set by relay T2, it can not again be started without first sounding the alarm 16 for the same time period as the original.

Figure 2:
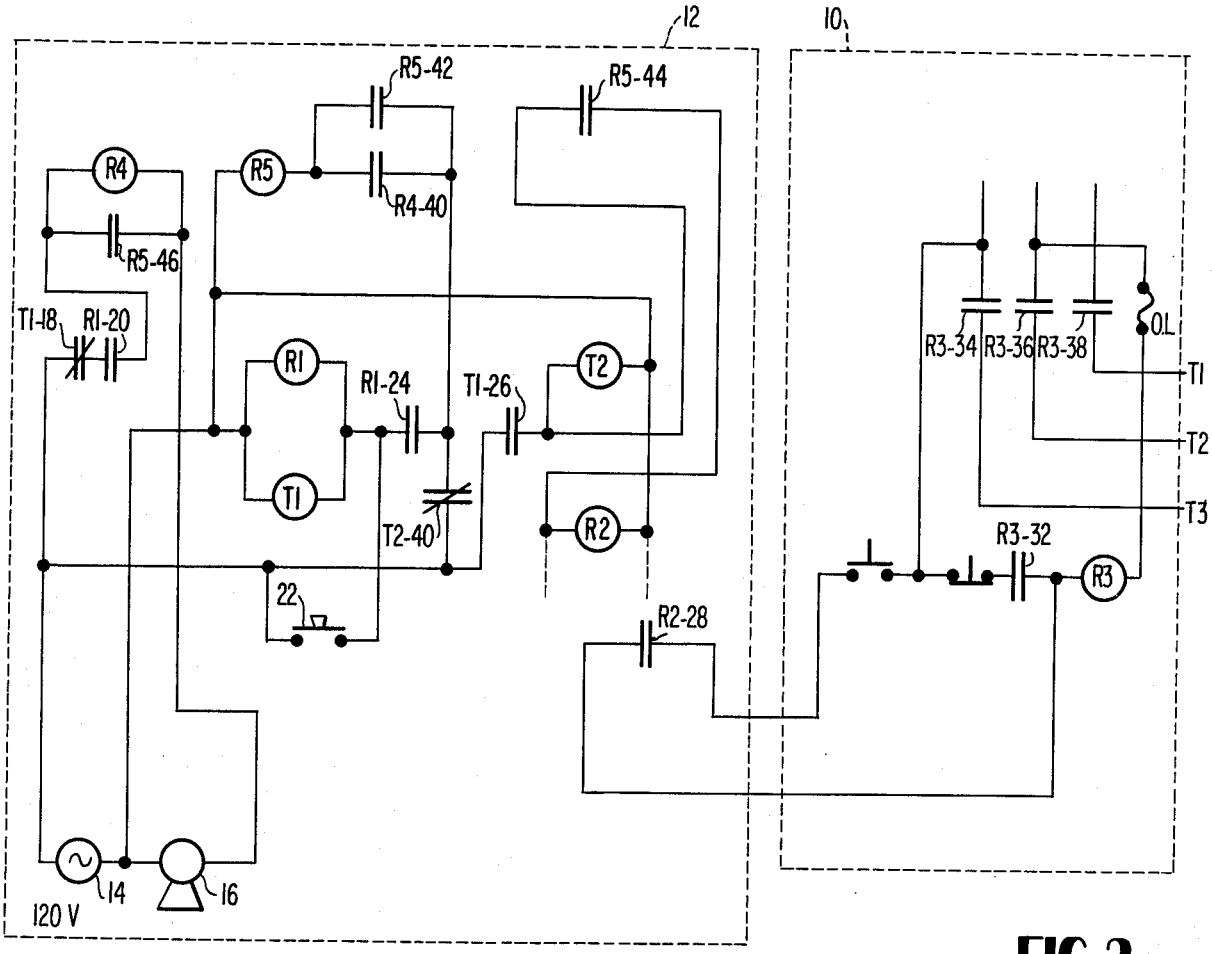
FIG. 2 shows an alternative embodiment

Referring now to FIG. 2, this is essentially the same circuit as FIG. 1 but with some added components to enhance the fail safe aspect of the alarm circuit. A fourth relay R4 is connected in series with the horn 16 and is effective when energized to close normally opened contacts R4-40 to energize a further relay R5 which locks in through its own normally open contacts R5-42. This also closes normally open contacts R5-44 to permit the energization of R2 in the circuit described with reference to FIG. 1.

The effect of this added circuity is that when voltage is applied to R4 and to the horn 16 to energize R5, R5 also closes its normally open contacts R5-46 which shunts relay R4 and permits it to drop out. Unless the circuit through the horn 16 is complete, R4 will not be energized and therefore R2 never becomes energized and the equipment can not be started. Thus, if there was a loose connection in the circuit to the horn 16, R4 could not be energized and therefore starting of the equipment is positively prevented until such time as the horn 16 can be sounded for the predetermined time period set by the time delay relay T1.

While preferred embodiments of the present invention have been herein shown and described, applicant claims the benefit of a full range of equivalents within the scope of the appended claims.

I claim:

1. A safety circuit for use in connection with power driven industrial machinery comprising:

a start circuit for the machinery;

alarm means;

means interlocked with said start circuit disabling operation thereof until said alarm means has been energized for a predetermined time;

manual means for energizing said alarm;

means in circuit with said alarm for terminating said alarm after a predetermined time;

means responsive to termination of said alarm for enabling said start circuit; and means for disabling said start circuit in the event that the equipment with which it is associated does not start within a predetermined time following termination of said alarm.

2. A safety circuit as defined by claim 1 including a first timing means connected to be energized concurrently with said alarm and operative to time out said alarm after a predetermined period and simultaneously enable said start circuit; and second timing means energized by time out of said first timing means to disable said start circuit after a second predetermined time.

3. A safety circuit as defined by claim 1 and including fail safe means connected to said alarm means and responsive to open circuit conditions in said alarm means for preventing enabling of said start circuit.

* * * * *